US010535362B2

(12) United States Patent
Bryan et al.

(10) Patent No.: US 10,535,362 B2
(45) Date of Patent: Jan. 14, 2020

(54) SPEECH ENHANCEMENT FOR AN ELECTRONIC DEVICE

(71) Applicant: Apple Inc., Cupertino, CA (US)

(72) Inventors: Nicholas J. Bryan, Saratoga, CA (US); Vasu Iyengar, Pleasanton, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/909,513

(22) Filed: Mar. 1, 2018

(65) Prior Publication Data

US 2019/0272842 A1 Sep. 5, 2019

(51) Int. Cl.

| | |
|---|---|
| ***G10L 21/0232*** | (2013.01) |
| ***G10L 21/028*** | (2013.01) |
| ***H04R 3/00*** | (2006.01) |
| ***G10L 21/02*** | (2013.01) |
| *G10L 21/0216* | (2013.01) |

(52) U.S. Cl.

CPC ..... *G10L 21/0232* (2013.01); *G10L 21/0205* (2013.01); *G10L 21/028* (2013.01); *H04R 3/005* (2013.01); *G10L 2021/02166* (2013.01)

(58) Field of Classification Search

None

See application file for complete search history.

(56) References Cited

U.S. PATENT DOCUMENTS

| | | | |
|---|---|---|---|
| 9,363,596 B2 | 6/2016 | Dusan et al. | |
| 9,749,738 B1 | 8/2017 | Adsumilli et al. | |
| 2007/0021958 A1* | 1/2007 | Visser | G10L 21/0272 704/226 |
| 2009/0103744 A1 | 4/2009 | Klinghult et al. | |
| 2014/0093091 A1 | 4/2014 | Dusan et al. | |
| 2014/0270231 A1* | 9/2014 | Dusan | G10L 25/90 381/74 |
| 2017/0070814 A1 | 3/2017 | Lu et al. | |
| 2017/0178664 A1 | 6/2017 | Wingate et al. | |

OTHER PUBLICATIONS

Kim, Taesu, Intae Lee, and Te-Won Lee. "Independent vector analysis: definition and algorithms." Signals, Systems and Computers, 2006. ACSSC'06. Fortieth Asilomar Conference on. IEEE, 2006. (Year: 2006).*

Miyabe, Shigeki, et al. "Blind compensation of interchannel sampling frequency mismatch for ad hoc microphone array based on maximum likelihood estimation," Signal Processing, vol. 107, Feb. 1, 2015, pp. 185-196.

(Continued)

*Primary Examiner* — Antim G Shah

(74) *Attorney, Agent, or Firm* — Womble Bond Dickinson (US) LLP

(57) ABSTRACT

Signals are received from audio pickup channels that contain signals from multiple sound sources. The audio pickup channels may include one or more microphones and one or more accelerometers. Signals representative of multiple sound sources are generated using a blind source separation algorithm. It is then determined which of those signals is deemed to be a voice signal and which is deemed to be a noise signal. The output noise signal may be scaled to match a level of the output voice signal, and a clean speech signal is generated based on the output voice signal and the scaled noise signal. Other aspects are described.

18 Claims, 8 Drawing Sheets

(56) References Cited

OTHER PUBLICATIONS

Smaragdis, P. (1998). Blind separation of convolved mixtures in the frequency domain. Neurocomputing, 22(1)121-34.
Bell, A. J. and Sejnowski, T. J. (1995). An information-maximization approach to blind separation and blind deconvolution. Neural computation, 7(6):1129-1159.
Gannot, S., Vincent, E., Markovich-Golan, S., and Ozerov, A. (2016). A consolidated perspective on multi-microphone speech enhancement and source sepa¬ration. IEEE/ACM Transactions on Audio, Speech and Language Processing.
Herault, J., Jutten, C., and Denker, J. S. (1986). Space or time adaptive signal processing by neural network models. In AIP conference proceedings, vol. 151, pp. 206-211. AIP.
Kim, T., Attias, H. T., Lee, S.-Y., and Lee, T.-W. (2007). Blind source separation exploiting higher-order frequency dependencies. IEEE Transactions on Au¬dio, Speech, and Language Processing, 15(1):70-79.
Matsuoka, K. and Nakashima, S. (2002). Minimal distortion principle for blind source separation. In Proceedings of the 41st SICE Annual Conference, vol. 4, pp. 2138-2143.
Comon, P. (1994). Independent component analysis, a new concept? Signal processing, 36(3):287-314.

* cited by examiner

SPEECH ENHANCEMENT FOR AN ELECTRONIC DEVICE

FIELD

Aspects of the disclosure here relate generally to a system and method of speech enhancement for electronic devices such as, for example, headphones (e.g., earbuds), audio-enabled smart glasses, virtual reality headsets, or mobile phone devices. Specifically, the use of blind source separation algorithms for digital speech enhancement is considered.

BACKGROUND

Currently, a number of consumer electronic devices are adapted to receive speech via microphone ports or headsets. While the typical example is a portable telecommunications device (e.g., a mobile telephone), with the advent of Voice over IP (VoIP), desktop computers, laptop computers, and tablet computers may also be used to perform voice communications. Further, hearables, smart headsets or earbuds, connected hearing aids and similar devices are advanced wearable electronic devices that can perform voice communication, along with a variety of other purposes, such as music listening, personal sound amplification, audio transparency, active noise control, speech recognition-based personal assistant communication, activity tracking, and more.

Thus, when using these electronic devices, the user has the option of using the handset, headphones, earbuds, headset, or hearables to receive his or her speech. However, a common complaint is that the speech captured by the microphone port or the headset includes environmental noise such as wind noise, secondary speakers in the background or other background noises. This environmental noise often renders the user's speech unintelligible and thus, degrades the quality of the voice communication.

BRIEF DESCRIPTION OF THE DRAWINGS

The various aspects of the disclosure are illustrated by way of example and not by way of limitation in the figures of the accompanying drawings in which like references indicate similar elements. It should be noted that references to "an" or "one" aspect are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Figure 1:
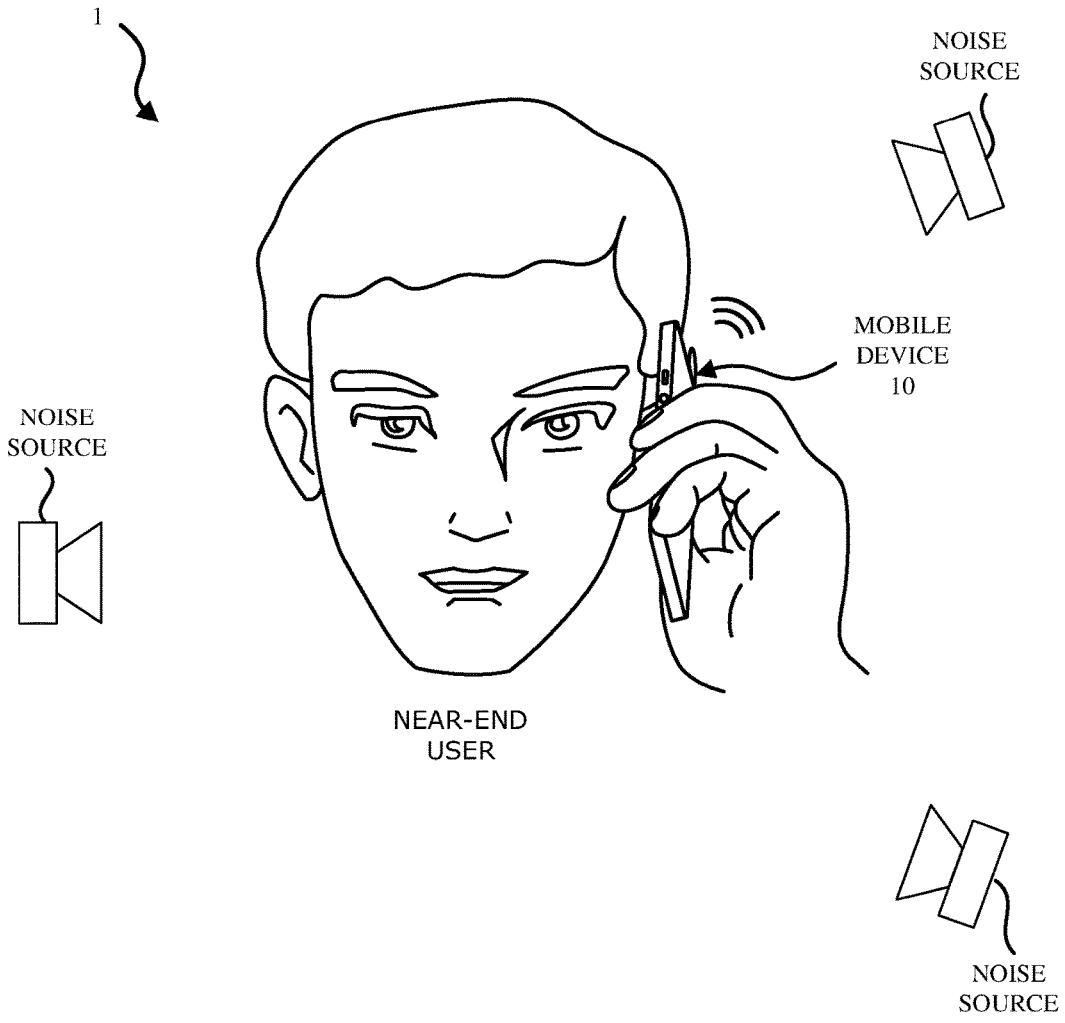
FIG. 1 illustrates an example of an electronic device in use.

In the following description, numerous specific details are set forth. However, it is understood that aspects of in the disclosure may be practiced without these specific details. Whenever the shapes, relative positions and other aspects of the parts described are not explicitly defined, the scope of the disclosure is not limited only to the parts shown, which are meant merely for the purpose of illustration. In other instances, well-known circuits, structures, and techniques have not been shown to avoid obscuring the understanding of this description.

In the description, certain terminology is used to describe features of the invention. For example, in certain situations, the terms "component," "unit," "module," and "logic" are representative of computer hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Of course, the hardware may be alternatively implemented as a finite state machine or even combinatorial logic. An example of "software" includes processor executable code in the form of an application, an applet, a routine or even a series of instructions. The software may be stored in any type of machine-readable medium.

Noise suppression algorithms are commonly used to enhance speech quality in modern mobile phones, telecommunications, and multimedia systems. Such techniques remove unwanted background noises caused by acoustic environments, electronic system noises, or similar sources. Noise suppression may greatly enhance the quality of desired speech signals and the overall perceptual performance of communication systems. However, mobile phone handset noise reduction performance can vary significantly depending on, for example: 1) the signal-to-noise ratio of the noise compared to the desired speech, 2) directional robustness or the geometry of the microphone placement in the device relative to the unwanted noisy sounds, 3) handset positional robustness or the geometry of the microphone placement relative to the desired speaker, and, 4) the non-stationarity of the unwanted noise sources.

In multi-channel noise suppression, the signals from multiple microphones are processed in order to generate a single clean speech signal. Blind source separation is the task of separating a set of two or more distinct sound sources from a set of mixed signals with little-to-no prior information. Blind source separation algorithms include independent component analysis (ICA), independent vector analysis (IVA), non-negative matrix factorization (NMF), and Deep-Neural Networks (DNNs). As used herein, an algorithm or process that performs blind source separation, or the processor that is executing the instructions that implement the algorithm, may be referred to as a "blind source separator" (BSS). These methods are designed to be completely general and typically make little-to-no assumptions on microphone position or sound source characteristics.

However, blind source separation algorithms have several limitations that hinder their real-world applicability. For instance, some algorithms do not operate in real-time, suffer from slow convergence time, exhibit unstable adaptation, and have limited performance for certain sound sources (e.g. diffuse noise) and/or microphone array geometries. The latter point becomes significant in electronic devices that have small microphone arrays (e.g., hearables). Typical separation algorithms may also be unaware of what sound sources they are separating, resulting in what is called the external "permutation problem" or the problem of not knowing which output signal corresponds to which sound source. As a result, for example, blind separation algorithms can mistakenly output the unwanted noise signal rather than the desired speech when used for voice communication.

Aspects of the disclosure relate generally to a system and method of speech enhancement for electronic devices such as, for example, headphones (e.g. earbuds), audio-enabled smart glasses, virtual reality headset, or mobile phone devices. Specifically, embodiments of the invention use blind source separation algorithms. Blind source separation algorithms are for pre-processing voice signals to improve speech intelligibility for voice communication systems and reduce the word error rate (WER) for speech recognition systems.

The electronic device includes one or more microphones and one or more accelerometers both of which are intended to receive captured voice signals of speech of a wearer or user of the device, and a processor to process the captured signals using a multi-modal blind source separation algorithm (a BSS processor.) As described below, the BSS processor may blend the accelerometer and microphone signals together in a way that leverages the accelerometer signal's natural robustness against external or acoustic noise (e.g., babble, wind, car noise, interfering speech, etc.) to improve speech quality; (ii) the accelerometer signals may be used to resolve the external permutation problem and to identify which of the separated outputs is the desired user's voice; and (iii) the accelerometer signals may be used to improve convergence and performance of the separation algorithm.

FIG. 1 depicts a near-end user using an exemplary electronic device 10 in which aspects of the disclosure may be implemented. The electronic device 10 may be a mobile phone handset device such as a smart phone or a multi-function cellular phone. The sound quality improvement techniques using double talk detection and acoustic echo cancellation described herein can be implemented in such a device, to improve the quality of the near-end audio signal. In FIG. 1, the near-end user is in the process of a call with a far-end user (not shown) who is using another communications device. The term "call" is used here generically to refer to any two-way real-time or live audio communications session with a far-end user (including a video call which allows simultaneous audio). Note however the processes described here for speech enhancement are also applicable to an audio signal produced by a one-way recording or listening session, e.g., while the user is recording her own voice.

Figure 2:
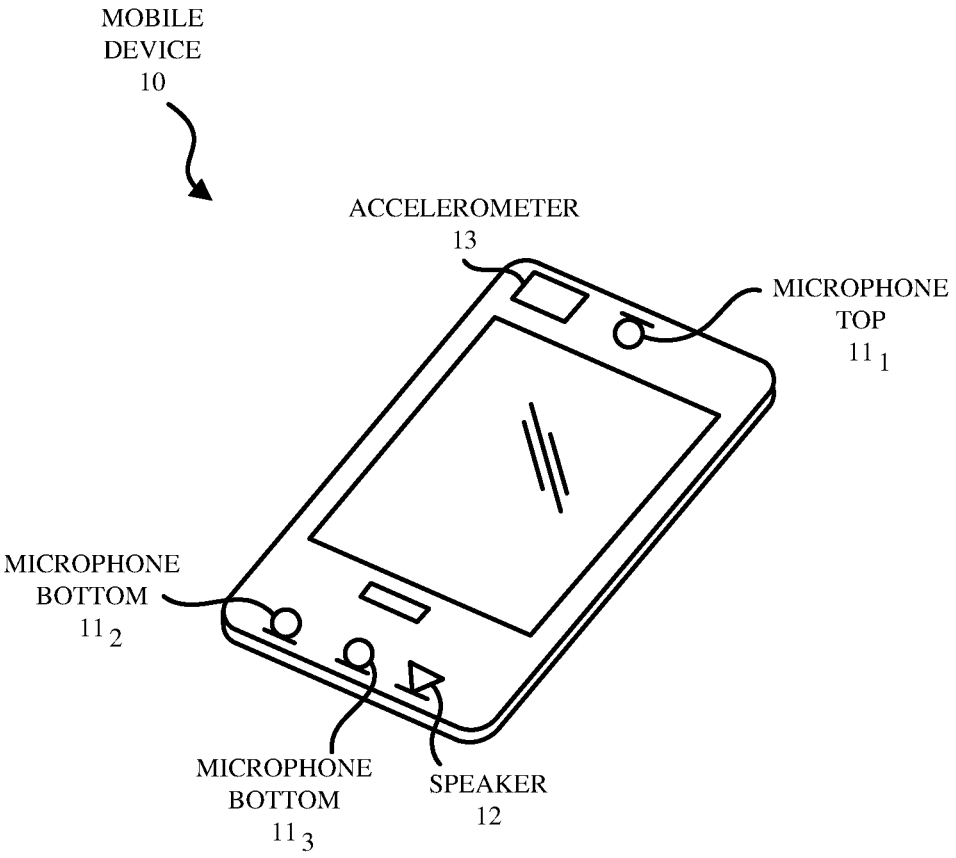
FIG. 2 illustrates the electronic device of FIG. 1 in which aspects of the disclosure may be implemented.

FIG. 2 depicts an exemplary device 10 that may include a housing having a bezel to hold a display screen on the front face of the device as shown. The display screen may also include a touch screen. The device 10 may also include one or more physical buttons and/or virtual buttons (on the touch screen). As shown in FIG. 2, the electronic device 10 may include one or more microphones $\mathbf{11}_1$-$\mathbf{11}_n$ ($n \geq 1$), a loudspeaker 12, and an accelerometer 13. While FIG. 2 illustrates three microphones including a top microphone $\mathbf{11}_1$ and two bottom microphones $\mathbf{11}_2$-$\mathbf{11}_3$, it is understood that more generally the electronic device may have one or more microphones and the microphones may be at various locations on the device 10. In the case where only one microphone and one accelerometer in the device 10 is being used by the separation process, the separation process described may only be effective up to the bandwidth of the accelerometer (e.g., 800 Hz.) Adding more microphones may extend the bandwidth of the separation process to the full audio band.

The accelerometer 13 may be a sensing device that measures proper acceleration in three directions, X, Y, and Z or in only one or two directions. When the user is generating voiced speech, the vibrations of the user's vocal chords are filtered by the vocal tract and cause vibrations in the bones of the user's head which are detected by the accelerometer 13 which is housed in the device 10. The term "accelerometer" is used generically here to refer to other suitable mechanical vibration sensors including an inertial sensor, a gyroscope, a force sensor or a position, orientation and movement sensor. While FIG. 2 illustrates a single accelerometer located near the microphone top 11_1, it is understood that there may be multiple accelerometers two or more of which may be used to produce the captured voice signal of the user of the device 10.

The microphones $\mathbf{11}_1$-$\mathbf{11}_n$ may be air interface sound pickup devices that convert sound into an electrical signal. In FIG. 2, a top front microphone $\mathbf{11}_1$ is located at the top of the device 10 which in the example here being a mobile phone handset rests the ear or cheek of the user. A first bottom microphone $\mathbf{11}_2$ and a second bottom microphone $\mathbf{11}_3$ are located at the bottom of the device 10. The loudspeaker 12 is also located at the bottom of the device 10. The microphones $\mathbf{11}_1$-$\mathbf{11}_3$ may be used as a microphone array for purposes of pickup beamforming (spatial filtering) with beams that can be aligned in the direction of user's mouth or steered to a given direction. Similarly, the beamforming could also exhibit nulls in other given directions.

The loudspeaker 12 generates a speaker signal for example based on a downlink communications signal. The loudspeaker 12 thus is driven by an output downlink signal that includes the far-end acoustic signal components. As the near-end user is using the device 10 to transmit their speech, ambient noise surrounding the user may also be present (as depicted in FIG. 1.) Thus, the microphones $\mathbf{11}_1$-$\mathbf{11}_3$ capture the near-end user's speech as well as the ambient noise around the device 10. The downlink signal that is output from a loudspeaker 12 may also be captured by the microphones $\mathbf{11}_1$-$\mathbf{11}_3$, and if so, the downlink signal that is output from the loudspeaker 12 could get fed back in the near-end device's uplink signal to the far-end device's downlink signal. This downlink signal would in part drive the far-end device's loudspeaker, and thus, components of this downlink signal would be included in the near-end device's uplink signal that is transmitted to the far-end device as echo. Thus, the microphone $\mathbf{11}_1$-$\mathbf{11}_3$ may receive at least one of: a near-end talker signal, ambient near-end noise signal, and the loudspeaker signal.

Figure 3:
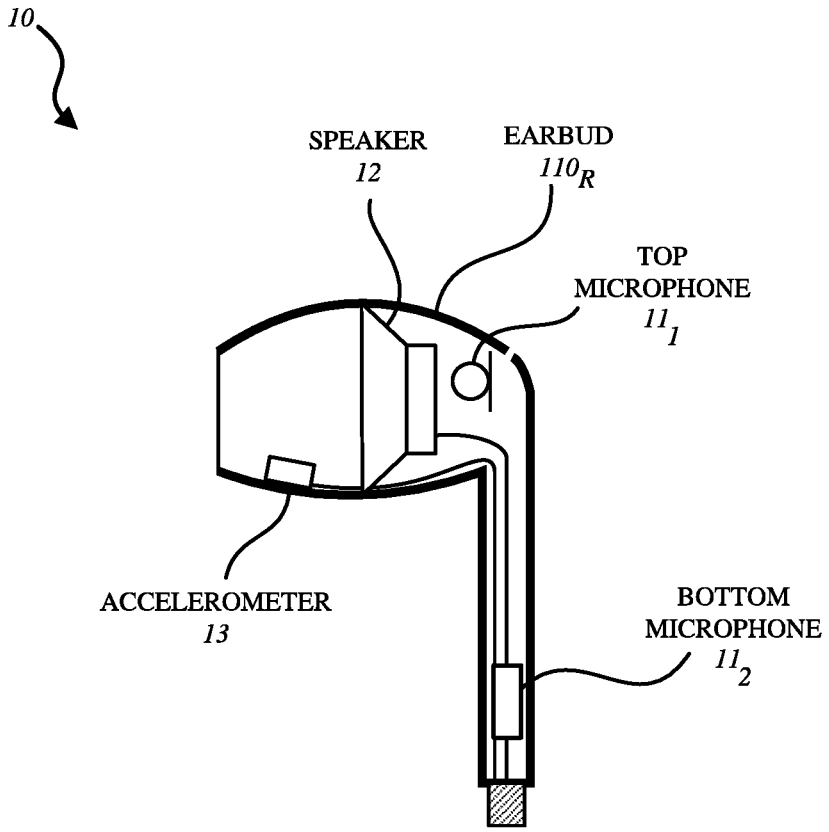
FIG. 3 illustrates another electronic device in which aspects of the disclosure may be implemented.

FIG. 3 illustrates another exemplary electronic device in which the processes described here may be implemented. Specifically, FIG. 3 illustrates an example of the right side (e.g., right earbud $\mathbf{110}_R$) of a headset that may be used in conjunction with an audio consumer electronic device such as a smartphone or tablet computer to which the microphone signals are transmitted from the headset (e.g., the right earbud 110R transmits its microphone signals to the smartphone.) In such an aspect, the BSS algorithm and the rest of the speech enhancement process may be performed by a processor inside the smartphone or tablet computer, upon receiving the microphone signals from a wired or wireless data communication link with the headset. It is understood that a similar configuration may be included in the left side of the headset. While the electronic device 10 in FIG. 3 is illustrated as being in part a pair of wireless earbuds, it is understood that the electronic device 10 may also be in part a pair of wired earbuds including a headset wire. Also, the user may place one or both of the earbuds into their ears and the microphones in the headset may receive their speech. The headset may be a double-earpiece headset. It is understood that single-earpiece or monaural headsets may also be used. The headset may be an in-ear type of headset that includes a pair of earbuds which are placed inside the user's ears, respectively, or the headset may include a pair of earcups that are placed over the user's ears. Further, the earbuds may be untethered wireless earbuds that communicate with each other and with an external device such as a smartphone or a tablet computer via Bluetooth™ signals.

Referring to FIG. 3, the earbud $\mathbf{110}_R$ includes a speaker 12, an inertial sensor for detecting movement or vibration of the earbud 110R, such as an accelerometer 13, a top microphone $\mathbf{11}_1$ whose sound sensitive surface faces a direction that is opposite the eardrum, and a bottom microphone $\mathbf{11}_2$ that is located in the end portion of the earbud $\mathbf{110}_R$ where it is the closest microphone to the user's mouth. In one aspect, the top and bottom microphones $\mathbf{11}_1$, $\mathbf{11}_2$ can be used as part of a microphone array for purposes of pick up beamforming. More specifically, the microphone arrays may be used to create microphone array beams which can be steered to a given direction by emphasizing and deemphasizing selected top and bottom microphones $\mathbf{11}_1$, $\mathbf{11}_2$ (e.g., to enhance pick up of the user's voice from the direction of her mouth.) Similarly, the microphone array beamforming can also be configured to exhibit or provide pickup nulls in other given directions, for to thereby suppress pickup of an ambient noise source. Accordingly, the beamforming process, also referred to as spatial filtering, may be a signal processing technique using the microphone array for directional sound reception.

As pointed out above, the beamforming operations, as part of the overall digital speech enhancement process, may also be performed by a processor in the housing of the smartphone or tablet computer (rather than by a processor inside the housing of the headset itself.) In one aspect, each of the earbuds $\mathbf{110}_L$, $\mathbf{110}_R$ is a wireless earbud and may also include a battery device, a processor, and a communication interface (not shown). The processor may be a digital signal processing chip that processes the acoustic signal (microphone signal) from at least one of the microphones $\mathbf{11}_1$, $\mathbf{11}_2$ and the inertial sensor output from the accelerometer 13 (accelerometer signal). The communication interface may include a Bluetooth™ receiver and transmitter to communicate acoustic signals from the microphones $\mathbf{11}_1$, $\mathbf{11}_2$, and the inertial sensor output from the accelerometer 13 wirelessly in both directions (uplink and downlink), with an external device such as a smartphone or a tablet computer.

When the user speaks, his speech signals may include voiced speech and unvoiced speech. Voiced speech is speech that is generated with excitation or vibration of the user's vocal chords. In contrast, unvoiced speech is speech that is generated without excitation of the user's vocal chords. For example, unvoiced speech sounds include /s/, /sh/, /V, etc. Accordingly, in some embodiments, both types of speech (voiced and unvoiced) are detected in order to generate a voice activity detector (VAD) signal. The output data signal from accelerometer 13 placed in each earbud $\mathbf{110}_R$, $\mathbf{110}_L$ together with the signals from the microphones $\mathbf{11}_1$, $\mathbf{11}_2$ or from a beamformer may be used to detect the user's voiced speech. The accelerometer 13 may be a sensing device that measures proper acceleration in three directions, X, Y, and Z or in only one or two directions, or other suitable vibration detection device that can detect bone conduction. Bone conduction is when the user is generating voiced speech, and the vibrations of the user's vocal chords are filtered by the vocal tract and cause vibrations in the bones of the user's head which are detected by the accelerometer 13 (referred to as bone conduction.)

The accelerometer 13 is used to detect low frequency speech signals (e.g. 800 Hz and below). This is due to physical limitations of common accelerometer sensors in conjunction with human speech production properties. In some aspects, the accelerometer 13 may be (i) low-pass filtered to mitigate interference from non-speech signal energy (e.g. above 800 Hz), (ii) DC-filtered to mitigate DC energy bias, and/or (iii) modified to optimize the dynamic range to provide more resolution within a forced range that is expected to be produced by the bone conduction effect in the earbud.

1. An Accelerometer and Microphone-based Multimodal BSS Algorithm

Figure 4:
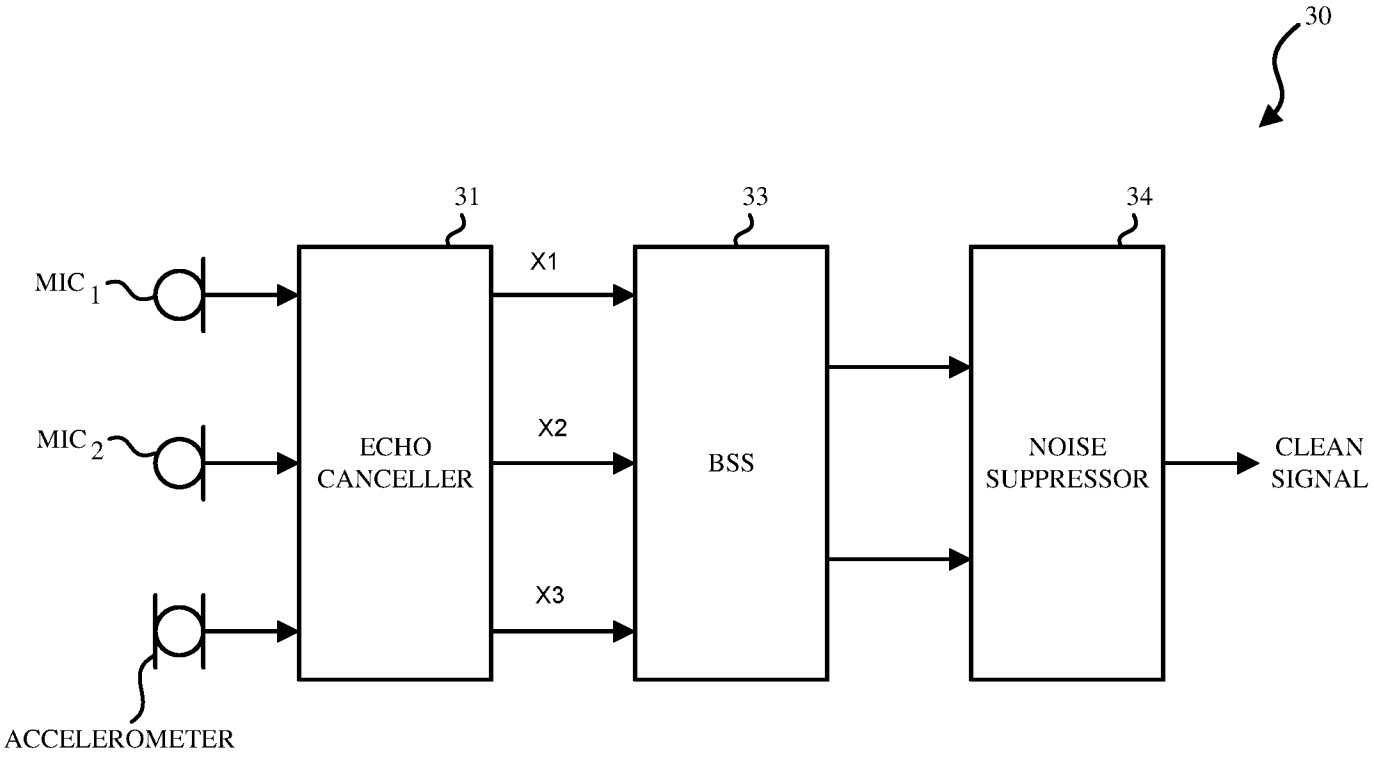
FIG. 4 is a block diagram of an example system of speech enhancement for an electronic device.

In one aspect, the signals captured by the accelerometer 13 as well as by the microphones $\mathbf{11}_1$-$\mathbf{11}_n$ are used in electronic devices 10 as shown in FIG. 2 and FIG. 3 by a multimodal BSS algorithm to enhance the speech in these devices 10. FIG. 4 illustrates a block diagram of a system 30 of speech enhancement for an electronic device 10 according to an embodiment of the invention. The system 30 includes an echo canceller 31, a blind source separator (BSS) 33 and a noise suppressor 34.

The system 30 may receive the acoustic signals from one or more microphones $\mathbf{11}_1$-$\mathbf{11}_n$ and the sensor signals from one or more accelerometers 13. In one aspect, the system 30 performs a form of IVA-based source separation using the one or more acoustic microphones $\mathbf{11}_1$-$\mathbf{11}_n$ and the one or more accelerometer sensor signals on the electronic device 10. In this aspect, the system 30 is able to automatically blend the acoustic signals from the microphones $\mathbf{11}_1$-$\mathbf{11}_n$ and the sensor signals from the accelerometers 13 and thus, leverage both the acoustic noise robustness properties of the sensor signals from the accelerometer 13 and the higher-bandwidth properties of the acoustic signals from the microphones $\mathbf{11}_1$-$\mathbf{11}_n$. In one aspect, the system 30 applies its processed outputs to other audio processing algorithms (not shown) to create a complete speech enhancement system used for various applications.

In the particular example of FIG. 4, the system 30 receives acoustic signals from two microphones $\mathbf{11}_1$-$\mathbf{11}_2$ and one sensor signal from one accelerometer 13. The echo canceller 31 may be an acoustic echo canceller (AEC) that provides echo suppression. For example, in FIG. 4, the echo canceller 31 may remove a linear acoustic echo from acoustic signals from the microphones $\mathbf{11}_1$-$\mathbf{11}_2$. In one aspect, the echo canceller 31 removes the linear acoustic echo from the acoustic signals in at least one of the bottom microphones $\mathbf{11}_2$ based on the acoustic signals from the top microphone $\mathbf{11}_1$. In another aspect, the echo canceller 31 is a multichannel echo suppressor that removes the linear acoustic echo from all microphone signals (microphones $\mathbf{11}_1$-$\mathbf{11}_n$) and from the accelerometer 13. In both instances, the echo suppression is performed upon the microphone signals (and optionally the accelerometer signals) upstream of the BSS 33 as shown.

In some aspects, the echo canceller 31 may also perform echo suppression and remove echo from the sensor signal from the accelerometer 13. The sensor signal from the accelerometer 13 provides information on sensed vibrations in the x, y, and z directions. In one aspect, the information on the sensed vibrations is used as the user's voiced speech signals in the low frequency band (e.g., 800 Hz and under).

In one aspect, the acoustic signals from the microphones $11_1$-$11_n$ and the sensor signals from the accelerometer 13 may be in the time domain. In another aspect, prior to being received by the echo canceller 31 or after the echo canceller 31, the acoustic signals from the microphones $11_1$-$11_n$ and the sensor signals from the accelerometer 13 are first transformed from a time domain to a frequency domain by filter bank analysis. In one aspect, the signals are transformed from a time domain to a frequency domain using the short-time Fourier transform, or a sequence of windowed Fast Fourier Transforms (FFTs). The echo canceller 31 may then output enhanced acoustic signals from the microphones $11_1$-$11_n$ that are echo cancelled acoustic signals from the microphones $11_1$-$11_n$. The echo canceller 31 may also output enhanced sensor signals from the accelerometer 13 that are echo cancelled sensor signals from the accelerometer 13.

In order to improve directional and non-stationary noise suppression, the BSS 33 included in system 30 may be configured to adapt (e.g. in real-time or offline) to account for changes in the geometry of the microphone placement relative to the unwanted noisy sounds. The BSS 33 improves separation of the speech and noise in the signals in the beamforming case, by omitting noise from the desired output voice signal (voicebeam) and omitting voice from the desired output noise signal (noisebeam).

In FIG. 4, the BSS 33 receives the signals ($X_1$, $X_2$, $X_3$) from the echo canceller 31. In some aspects, these signals are signals from a plurality of audio pickup channels (e.g. microphones or accelerometers) including in this example a first channel, a second channel, and a third channel, wherein the inputs to the BSS 33 here include the two channels associated with the microphones $11_1$-$11_2$ (e.g., in a mobile phone handset, or as the left and right outside microphones of a headset) and one channel from the accelerometer 13. In other aspects, there is only one microphone channel and only one accelerometer channel.

As shown in FIG. 1, the signals from at least two audio pickup channels include signals from a plurality of sound sources. For example, the sound sources may be the near-end speaker's speech, the loudspeaker signal including the far-end speaker's speech, environmental noises, etc.

Figure 5:
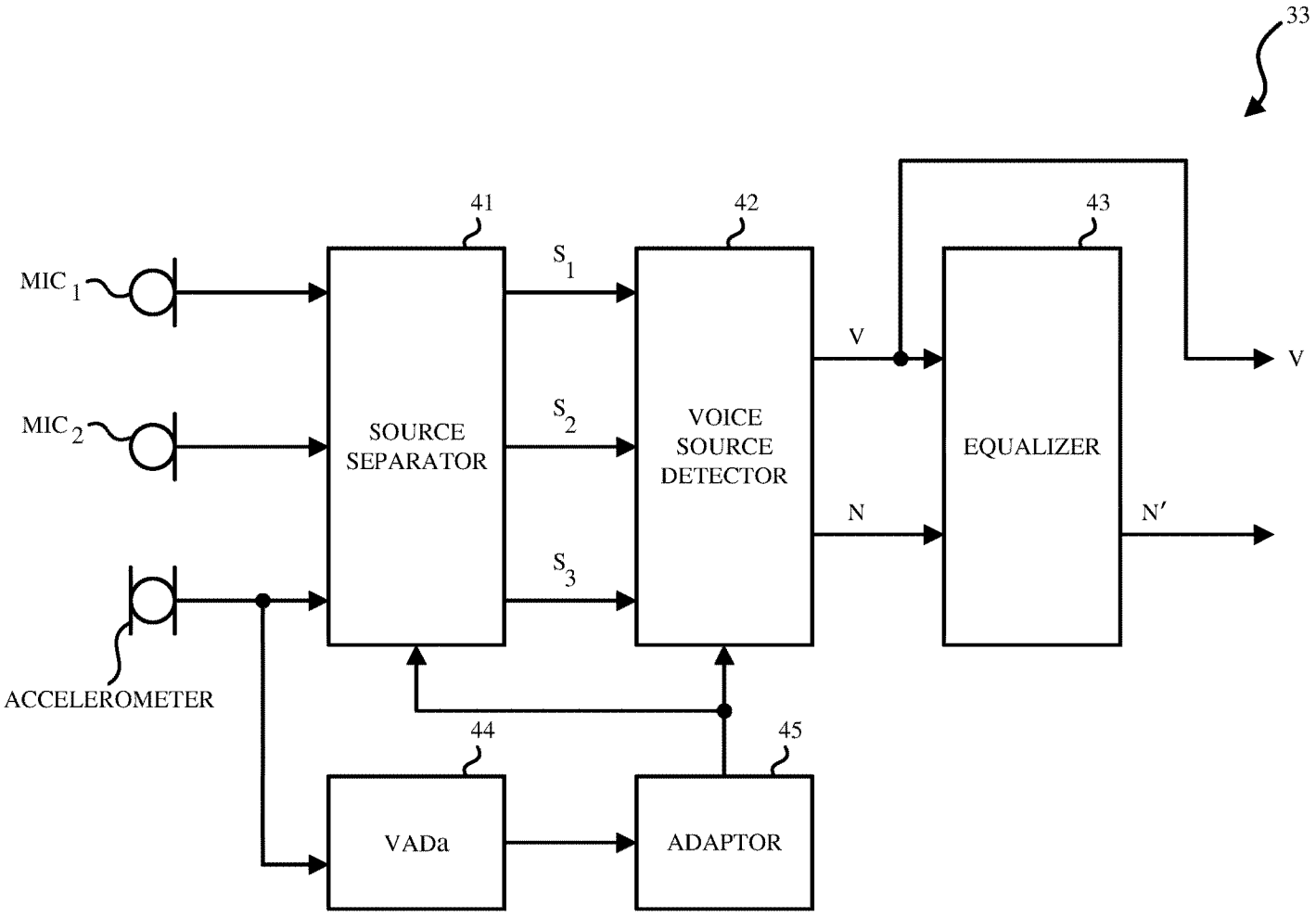
FIG. 5 is a block diagram of an example BSS algorithm included in the system for speech enhancement.
Figure 6:
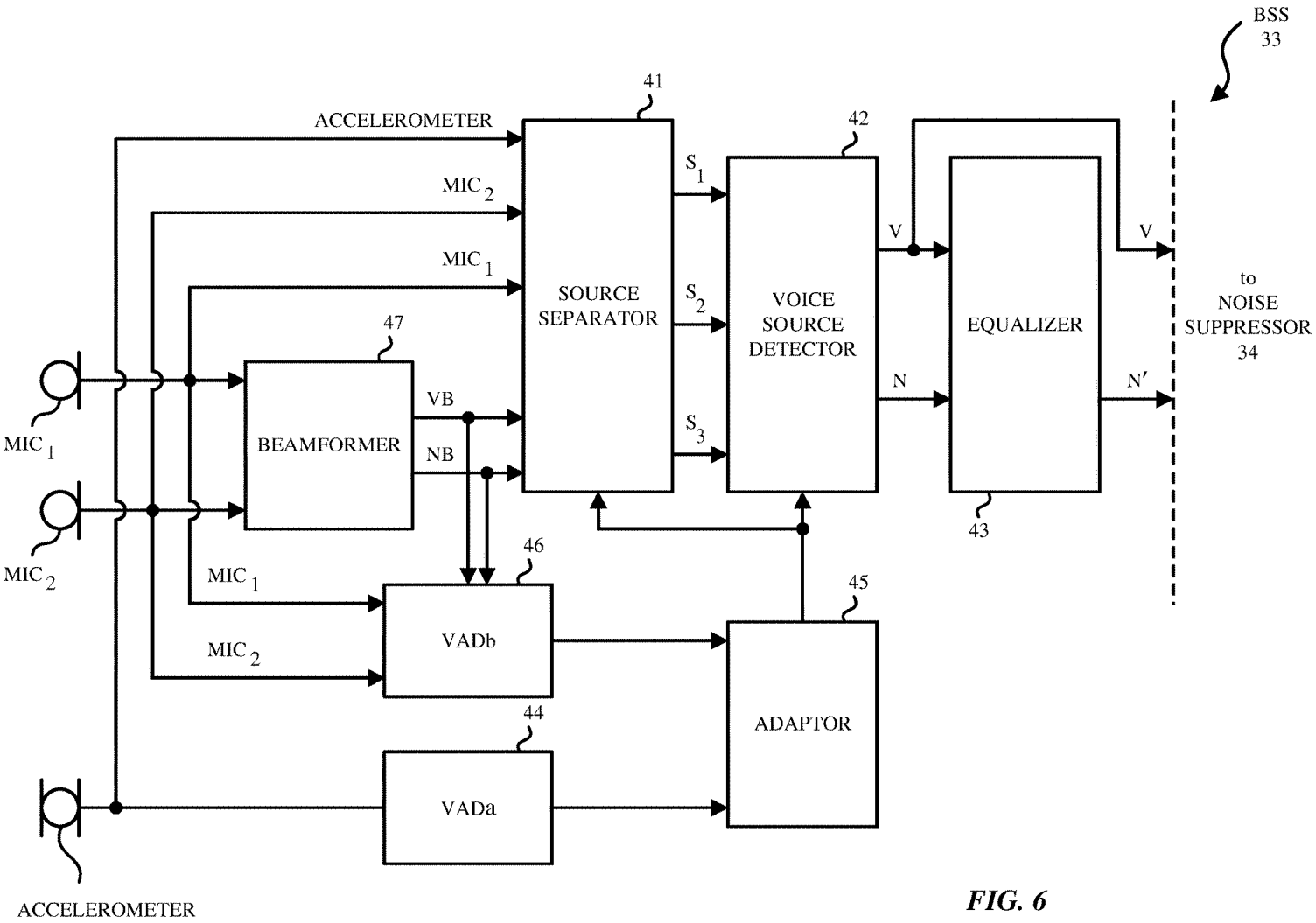
FIG. 6 illustrates a block diagram of a BSS configured to work with beamformer assistance.

FIGS. 5 and 6 respectively illustrates block diagrams of the BSS 33 included in the system 30 of noise speech enhancement for an electronic device 10 in FIG. 3 according to different embodiments of the invention. While only two microphones and one accelerometer are illustrated in FIGS. 5 and 6, it is understood that a plurality of microphones and a plurality of accelerometers may be used.

Referring to FIG. 5, the BSS 33 may include a sound source separator 41, a voice source detector 42, an equalizer 43, a VADa 44 and an adaptor 45.

In one aspect, the sound source separator 41 separates N number of sources from $N_m$ number of microphones ($N_m \geq 1$) and $N_a$ number of accelerometers ($N_a \geq 1$), where $N=N_m+N_a$. In one aspect, independent component analysis (ICA) may be used to perform this separation by the sound source separator 41. In FIG. 5, the sound source separator 41 receives signals from at least three audio pickup channels including a first channel, a second channel and a third channel. The plurality of sources may include a speech source, a noise source, and a sensor signal from the accelerometer 13.

In one aspect, using a linear mixing model, observed signals (e.g., $X_1$, $X_2$, $X_3$) are modeled as the product of unknown source signals (e.g., signals generated at the source ($S_1$, $S_2$, $S_3$) and a mixing matrix A (e.g., representing the relative transfer functions in the environment between the sources and the microphones $11_1$-$11_3$). The model between these elements may be shown as follows:

$$x = As$$

$$\begin{bmatrix} x_1 \\ x_2 \\ x_3 \end{bmatrix} = \begin{bmatrix} a_{11} & a_{12} & a_{13} \\ a_{21} & a_{22} & a_{23} \\ a_{31} & a_{32} & a_{33} \end{bmatrix} \begin{bmatrix} s_1 \\ s_2 \\ s_3 \end{bmatrix}$$

Accordingly, an unmixing matrix W is the inverse of the mixing matrix A, such that the unknown source signals (e.g., signals generated at the source ($S_1$, $S_2$, $S_3$) may be solved. Instead of estimating A and inverting it, however, the unmixing matrix W may also be directly estimated or computed (e.g. to maximize statistical independence).

$$W=A^{-1}$$

$$s=Wx$$

In one aspect, the unmixing matrix W may also be extended per frequency bin:

$$W[k]=A^{-1}[k]\forall k=1,2,\ldots,K$$

k is the frequency bin index and K is the total number of frequency bins.

The sound source separator 41 outputs the source signals $S_1$, $S_2$, $S_3$ that can be the signal representative of the first sound source, the signal representative of the second sound source, and the signal representative of the third sound source, respectively.

In one aspect, the observed signals ($X_1$, $X_2$, $X_3$) are first transformed from the time domain to the frequency domain using the short-time Fast Fourier transform or by filter bank analysis as discussed above. The observed signals ($X_1$, $X_2$, $X_3$) may be separated into a plurality of frequencies or frequency bins (e.g., low frequency bin, mid frequency bin, and high frequency bin). In this aspect, the sound source separator 41 computes or determines an unmixing matrix W for each frequency bin, and outputs source signals $S_1$, $S_2$, $S_3$ for each frequency bin. However, when the sound source separator 41 solves the source signals $S_1$, $S_2$, $S_3$ for each frequency bin, the sound source separator 41 needs to further address the internal permutation problem, so that the source signals $S_1$, $S_2$, $S_3$ for each frequency bin are aligned. To address the internal permutation problem, in one embodiment, independent vector analysis (IVA) is used wherein each source is modeled as a vector across a plurality of frequencies or frequency bins (e.g., low frequency bin, mid frequency bin, and high frequency bin). In one aspect, independent component analysis can be used in conjunction with the near-field ratio (NFR) per frequency to determine the permutation ordering per frequency bin, for example as described in U.S. patent application Ser. No. 15/610,500 filed May 31, 2017, entitled "System and method of noise reduction for a mobile device." In this aspect, the NFR may be used to simultaneously solve both the internal and external permutation problems.

In one aspect, the source signals $S_1$, $S_2$, $S_3$ for each frequency bin are then transformed from the frequency domain to the time domain. This transformation may be achieved by filter bank synthesis or other methods such as inverse Fast Fourier Transform (IFFT).

2. Handling the Mismatch of Frequency Bandwidth Between Microphones and Accelerometers when Performing BSS As discussed above, the accelerometer 13 may only capture a limited range of frequency content (e.g., 20 Hz to 800 Hz). When the sensor signal from the accelerometer 13 is used together with the acoustic signals from the microphones $\mathbf{11}_1$-$\mathbf{11}_n$ that have a full-range of frequency content (e.g., 60 Hz to 24000 Hz) to perform BSS, numerical issues may arise, especially when processing in the frequency domain, unless the bandwidth mismatch is addressed explicitly. To overcome these issues, optimization equality constraints within an WA-based separation algorithm may be used. For example, the algorithm assumes N−1 microphone signals and one sensor signal from the accelerometer (in order) and adds linear equality constraints to obtain:

$$\underset{W[k],\,\forall k}{\operatorname{argmax}} = -\sum_{i=1}^{N} E|G(s_i)| + \sum_{f=1}^{F} \log|W[k]|,$$

$$w_{iN}[k] = 0,\ \forall\, i \neq N,\ \forall\, k > k_{f\theta}$$

$$w_{Ni}[k] = 0,\ \forall\, i \neq N,\ \forall\, k > k_{f\theta}$$

$$w_{NN}[k] = 1,\ \forall\, k > k_{f\theta}$$

In this embodiment, $w_{iN}[k]$ is the iN-th element of W[k], $w_{Ni}[k]$ is the Ni-th element of W[k], $w_{NN}[k]$ is the NN-th element of W[k], $k_{f\theta}$ is the accelerometer frequency bandwidth cutoff, the accelerometer is the Nth signal, si is the i-th source vector across frequency bins, and G(si) is a contrast function or related function representing a statistical model.

The purpose of the equality constraints is to limit the adaptation of the unmixing coefficients that correspond to the accelerometer 13 for frequencies that contain little-or-no energy. This improves numerical issues caused by the sensor bandwidth mismatch. Once we add the equality constraints, we can derive a new adaptive algorithm (e.g. gradient ascent/descent algorithm) to solve the updated optimization problem. Alternatively, the elements of W[k] may be initialized and fixed to satisfy the equality constraints and then intentionally not updated as the BSS is adapted to perform separation. In this aspect, existing algorithms may be reused with minimal changes. In another aspect, the BSS can be used to perform N-channel separation within one frequency range (low-frequency bandwidth for the accelerometer signals) and N−1-channel separation within another frequency range (high-frequency bandwidth for the microphone signals). For example, in the low frequency range (e.g., less than or equal to 800 Hz), a 3×3 matrix is used for the unmixing matrix W[k] per frequency bin and in the high frequency range (e.g., above 800 Hz), a 2×2 matrix may be used for the unmixing matrix W[k] per frequency bin. In this way, the accelerometer 13 may act as an incomplete, fractional sensor when compared to the microphone sensors. This mitigates the mismatch of frequency bandwidth between the accelerometer 13 and the microphones $\mathbf{11}_1$-$\mathbf{11}_n$, mitigating numerical problems and reducing computational cost.

Referring back to FIG. 5, once the source signals $S_1$, $S_2$, $S_3$ are separated and output by the sound source separator 41, the external permutation problem needs to be solved by the voice source detector 42. The voice source detector 42 needs to determine which output signal $S_1$, $S_2$, or $S_3$ corresponds to the voice signal and which output signal $S_1$, $S_2$ or $S_3$ corresponds to the noise signal. Referring back to FIG. 4, the voice source detector 42 receives the source signals $S_1$, $S_2$, $S_3$ from the sound source separator 41. The voice source detector 42 determines whether the signal from the first sound source is a voice signal (V) or a noise (unwanted sound) signal (N) or a noise signal from the accelerometer 13, whether the signal from the second sound source is the voice signal (V) or the noise signal (N) or a noise signal from the accelerometer 13, and whether the signal from the third sound source is the voice signal (V) or noise signal (N) or a noise signal from the accelerometer 13. In FIG. 4, the noise signal from the accelerometer 13 is discarded and not shown. In other aspects, the noise signal (N) and the noise signal from the accelerometer can be combined (e.g. added) to form a modified noise signal (N').

3. Identifying the Desired Voice Signal Using the Accelerometer Signal

To identify the desired voice signal from the multiple separated outputs, the one or more sensor signals from the accelerometer(s) 13 may be used to inform the separation algorithm in a way that predetermines which output channel corresponds to the voice signal. As shown in FIG. 5, VADa 44 receives the sensor signal from the accelerometer 13 and generates an accelerometer-based voice activity detector (VAD) signal. The accelerometer-based VAD signal (VADa) is then used to control the adaptor 45, which determines an adaptive prior probability distribution that, in turn, biases the statistical model or contrast function (e.g. G(si)) used to estimate the unmixing matrix. We can represent this relationship by updating the contrast function as G(si; θ), where θ represents the VAD signal or other such similar information. The voice source detector 42 then identifies which of the separated outputs corresponds to the desired voice, in this case, by simply choosing the voice signal to be the biased channel, resolving the external permutation problem.

In one aspect, the accelerometer-based voice activity detector (VADa) 44 receives the sensor signal from the accelerometer 13 and generates a VADa output by modeling the sensor signal from the accelerometer 13 as a summation of a voice signal and a noise signal as a function of time. Given this model, the noise signal is computed using one or more noise estimation methods. The VADa output may indicate speech activity, using a confidence level such as a real-valued or positive real valued number, or a binary value.

Based on the outputs of the accelerometer 13, an accelerometer-based VAD output (VADa) may be generated, which indicates whether or not speech generated by, for example, the vibrations of the vocal chords has been detected. In one embodiment, the power or energy level of the outputs of the accelerometer 13 is assessed to determine whether the vibration of the vocal chords is detected. The power may be compared to a threshold level that indicates the vibrations are found in the outputs of the accelerometer 13. If the power or energy level of the sensor signal from the accelerometer 13 is equal or greater than the threshold level, the VADa 44 outputs a VADa output that indicates that voice activity is detected in the signal. In some aspects, the VADa is a binary output that is generated as a voice activity detector (VAD), wherein 1 indicates that the vibrations of the vocal chords have been detected and 0 indicates that no vibrations of the vocal chords have been detected. In some aspects, the sensor signal from the accelerometer 13 may also be smoothed or recursively smoothed based on the output of VADa 44. In other aspects, the VADa itself is a real-valued or positive real-valued output that indicates the confidence of voice activity detected within the signal.

Referring back to FIG. 5, the adaptor 45 then maps the VADa output to control the variance parameter for the i-th source. Alternatively, depending on the employed parametric probability source distribution, other statistical parameters can be used as well. In one aspect, the adaptor 45 adapts the variance of one source (e.g., i=1, or $S_1$) which corresponds to the desired voice signal, and keeps the remaining values source probability distribution parameters fixed. In this manner, the adaptor 45 creates a time-varying adaptive prior probability distribution for the voice signal. In one aspect, this modification by the adaptor 45 biases the statistical model (alternatively, the contrast function) so that the desired voice signal always ends up in a known output channel (i.e., the biased channel). The desired output voice is thus able to be predetermined to be in the biased channel with respect to the separated outputs and thus, resolves the external permutation problem. Further, convergences and separation performance are also improved by leveraging additional information into the statistical estimation problem.

In one aspect, the adaptor 45 can be used to update one or more covariance matrices based on the input or output signals, which are useful for the BSS. This is done, for example, by using the adaptor 45 to increase or decrease the adaption rate of one or more covariance estimators. In doing so, a set of one or more covariance matrices are generated that include and/or exclude desired voice source signal energy. The set of estimated covariance matrices may be used to compute an unmixing matrix and perform separation (e.g. via independent component analysis, independent vector analysis, joint-diagonalization, and related method).

Referring to FIG. 5, voice source detector 42 receives the outputs from the source separator 41 and the adaptor 45, which causes the desired voice signal to be located at a predetermined (biased) channel. Accordingly, the voice source detector 42 is able to determine that the predetermined (biased) channel is the voice signal. For example, the signal from the first sound source may be the voice signal (V) if the first channel is the predetermined biased channel. The voice source detector 42 outputs the voice signal (V) and the noise signal (N).

When using the BSS 33 to separate signals prior to the noise suppressor 34, standard amplitude scaling rules (e.g. minimum distortion principle), necessary for independent component analysis (ICA), independent vector analysis (IVA), or related methods, may overestimate the output noise signal level. Accordingly, as shown in FIG. 5, the equalizer 43 may be provided that receives the output voice signal and the output noise signal and scales the output noise signal to match a level of the output voice signal to generate a scaled noise signal.

In one aspect, noise-only activity is detected by a voice activity detector VADa 44, and the equalizer 43 generates a noise estimate for at least one of the bottom microphones $\mathbf{11}_2$ (or for the output of a pickup beamformer—not shown). The equalizer 43 may generate a transfer function estimate from the top microphone $\mathbf{11}_1$ to at least one of the bottom microphones $\mathbf{11}_2$. The equalizer 43 may then apply a gain to the output noise signal (N) to match its level to that of the output voice signal (V).

In one aspect, the equalizer 43 determines a noise level in the output noise signal of the BSS 33, and also estimates a noise level for the output voice signal V and uses the latter to adjust the output noise signal N appropriately (to match the noise level after separation by the BSS 33.) In this aspect, the scaled noise signal is an output noise signal after separation by the BSS 33 that matches a residual noise found in the output voice signal after separation by the BSS 33.

Referring back to FIG. 4, the noise suppressor 34 receives the output voice signal and the scaled noise signal from the equalizer 43. The noise suppressor 34 may suppress noise in the signals thus received. For example, the noise suppressor 34 may remove at least one of a residual noise or a non-linear acoustic echo in the output voice signal, to generate the clean signal. The noise suppressor 34 may be a one-channel or two-channel noise suppressor and/or a residual echo suppressor.

4. Identifying the Desired Voice Signal Using Two or More Beamformed Microphones FIG. 6 illustrates a block diagram of the BSS 33 included in the system of noise speech enhancement for an electronic device 10 in FIG. 3 according to another aspect of the invention. In the aspect of FIG. 6, the desired voice signal may be identified from the multiple separated outputs using the signals from the two or more acoustic microphones on the electronic device 10 to inform the separation algorithm in a way that predetermines which output channel corresponds to the voice signal.

In contrast to FIG. 5, the system in FIG. 6 further includes a beamformer 47 and a beamformer-based VAD (VADb). The beamformer 47 receives, from the echo canceller 31, the enhanced acoustic signals captured by the microphones $\mathbf{11}_1$, and $\mathbf{11}_2$ and using linear spatial filtering (i.e. beamforming), the beamformer 47 creates an initial voice signal (i.e., voicebeam) and a noise reference signal (i.e., noisebeam). The voicebeam signal is an attempt at omitting unwanted noise, and the noisebeam signal is an attempt at omitting voice. The source separator in 41 further receives and processes the voicebeam signal and the noisebeam signal from the beamformer 47.

In one aspect, the beamformer 47 is a fixed beamformer that receives the enhanced acoustic signals from the microphones $\mathbf{11}_1$, $\mathbf{11}_2$ and creates a beam that is aligned in the direction of the user's mouth to capture the user's speech. The output of the beamformer may be the voicebeam signal. In one aspect, the beamformer 47 may also include a fixed beamformer to generate a noisebeam signal that captures the ambient noise or environmental noise. In one aspect, the beamformer 47 may include beamformers designed using at least one of the following techniques: minimum variance distortionless response (MVDR), maximum signal-to-noise ratio (MSNR), and/or other design methods. The result of each beamformer design process may be a finite-impulse response (FIR) filter or, in the frequency domain, a vector of linear filter coefficients per frequency. In one aspect, each row of the frequency-domain unmixing matrix (as introduced above) corresponds to a separate beamformer. In one aspect, the beamformer 47 computes the voice and noise reference signals as follows:

$$y_v[k,t]=w_v[k]^H x[k,t], \forall k=1,2,\ldots,K$$

$$y_n[k,t]=w_n[k]^H x[k,t], \forall k=1,2,\ldots,K$$

In equations above, the $w_v[k]$ $\forall k$ is the fixed voice beamformer coefficients, $w_n[k]$ $\forall k$ is the fixed noise beamformer coefficients, x[k, t] is the microphone signals over frequency and time, $y_v[k, t]$ is the voicebeam signal and $y_n[k, t]$ is the noisebeam signal.

In one aspect, the beamformer-based VAD (VADb) 46 receives the enhanced acoustic signals from the microphones $\mathbf{11}_1$, $\mathbf{11}_2$, and the voicebeam and the noisebeam signals from the beamformer 47. The VADb 46 computes the power or energy difference (or magnitude difference) between the voicebeam and the noisebeam signals to create a beamformer-based VAD (VADb) output to indicate whether or not speech is detected.

When the magnitude between the voicebeam signal and the noisebeam signal is greater than a magnitude difference threshold, the VADb output indicates that speech is detected.

The magnitude difference threshold may be a tunable threshold that controls the VADb sensitivity. The VADb output may also be (recursively) smoothed. In other aspects, the VADb output is a binary output that is generated as a voice activity detector (VAD), wherein 1 indicates that the speech has been detected in the acoustic signals and 0 indicates that no speech has been detected in the acoustic signals.

As shown in FIG. 6, the adaptor 45 may receive the VADb output. The VADb output may be used to control an adaptive prior probability distribution that, in turn, biases the statistical model used to perform separation. Similar to the VADa in FIG. 5, the VADb may bias the statistical model in a way that identifies which of the separated outputs corresponds to the desired voice (e.g., the biased channel), which resolves the external permutation problem. Using the VADb, the adaptor 45 only adapts the variance of one source (e.g., i=1), which corresponds to the desired voice signal and keeps the remaining values source probability distribution parameters fixed. This creates a time-varying adaptive prior probability distribution that informs and improves the separation method by biasing the statistical model so that the desired voice signal is always at a known output channel.

In some aspects, the adaptor 45 may use the VADb in combination with the accelerometer-based VAD output (VADa) to create a more robust system. In other aspects, the adaptor 45 may use the VADb output alone to detect voice activity when the accelerometer signal is not available.

Both the VADa and the VADb may be subject to erroneous detections of voiced speech. For instance, the VADa may falsely identify the movement of the user or the headset 100 as being vibrations of the vocal chords while the VADb may falsely identify noises in the environment as being speech in the acoustic signals. Accordingly, in one embodiment, the adaptor 45 may only determine that voice is detected if the coincidence between the detected speech in acoustic signals (e.g., VADb) and the user's speech vibrations from the accelerometer data output signals is detected (e.g., VADa). Conversely, the adaptor 45 may determine that voice is not detected if this coincidence is not detected. In other words, the combined VAD output is obtained by applying an AND function to the VADa and VADb outputs. In another embodiment, the adaptor 45 may prefer to be over inclusive when it comes to voice detection. Accordingly, the adaptor 45 in that embodiment would determine that voice is detected when either the VADa OR the VADb outputs indicate that voice is detected. In another embodiment, metadata from additional processing units (e.g. a wind detector flag) can be used to inform the adaptor 45, to for example ignore the VADb output.

The VADa 44 and VADb 46 in FIGS. 5-6 modify the BSS update algorithm, which improves the convergence and reduces the speech distortion. For instance, the independent vector analysis (IVA) algorithm performed in the BSS 33 is enhanced using the VADa and VADb outputs. As discussed above, the internal state variables of the BSS update algorithm may be modulated based on the VADa 44 and/or VADb 46 outputs. In another embodiment, the statistical model used for separation is biased (e.g. using a parameterized prior probability distribution) based on the external VAD's outputs to improve convergence.

The following aspects may be described as a process or method, which may be depicted as a flowchart, a flow diagram, a structure diagram, or a block diagram. Although a flowchart may illustrate or describe the operations of process as a sequence, one or more of the operations could be performed in parallel or concurrently. In addition, the order of the operations may also different in some cases.

Figure 7:
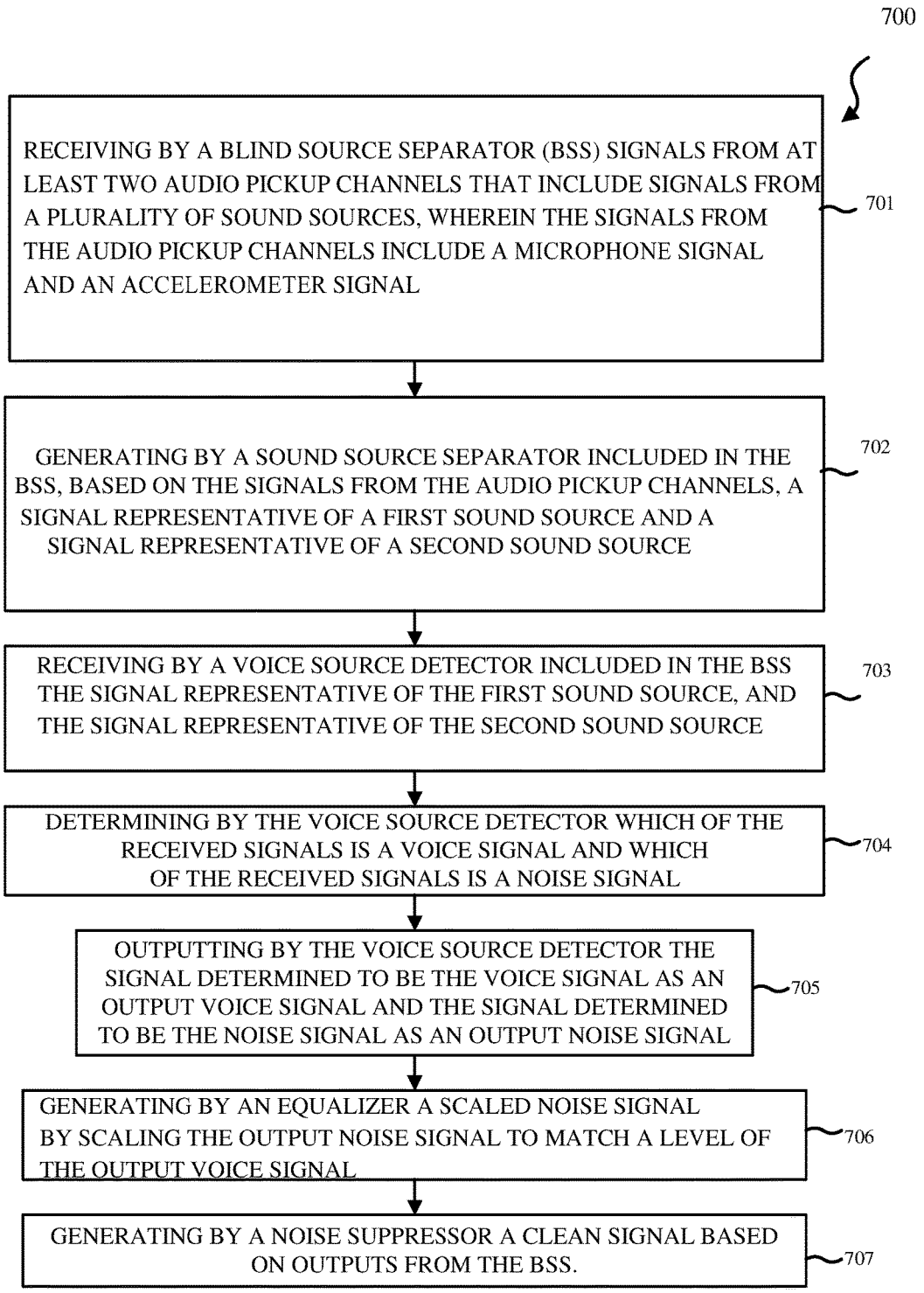
FIG. 7 illustrates a flow diagram of an example method of speech enhancement.

FIG. 7 illustrates a flow diagram of an example method 700 of speech enhancement for an electronic device according to one aspect of the disclosure. The method 700 may start with a blind source separator (BSS) receiving signals from at least two audio pickup channels including a first channel and a second channel at Block 701. The signals from at least two audio pickup channels may include signals from at least two sound sources. In one aspect, the BSS implements a multimodal algorithm upon the signals from the audio pickup channels which include an acoustic signal from a first microphone and a sensor signal from an accelerometer. As explained above, better performance across the full audio band may be had when there are at least two microphones and at least one accelerometer (at least three audio pickup channels) that are being input to the BSS.

At Block 702, a sound source separator included in the BSS generates based on the signals from the first channel, the second channel and the third channel, a signal representative of a first sound source, a signal representative of a second sound source, and a signal representative of a third sound source. At Block 703, a voice source detector included in the BSS receives the signals that are representative of those sound sources, and at Block 704, the voice source detector determines which of the received signals is a voice signal and which of the received signals is a noise signal. At Block 705, the voice source detector outputs the signal determined to be the voice signal as an output voice signal and outputs the signal determined to be the noise signal as an output noise signal. At Block 706, an equalizer included in the BSS generates a scaled noise signal by scaling the noise signal to match a level of the voice signal. At Block 707, a noise suppressor generates a clean signal based on outputs from the BSS.

Figure 8:
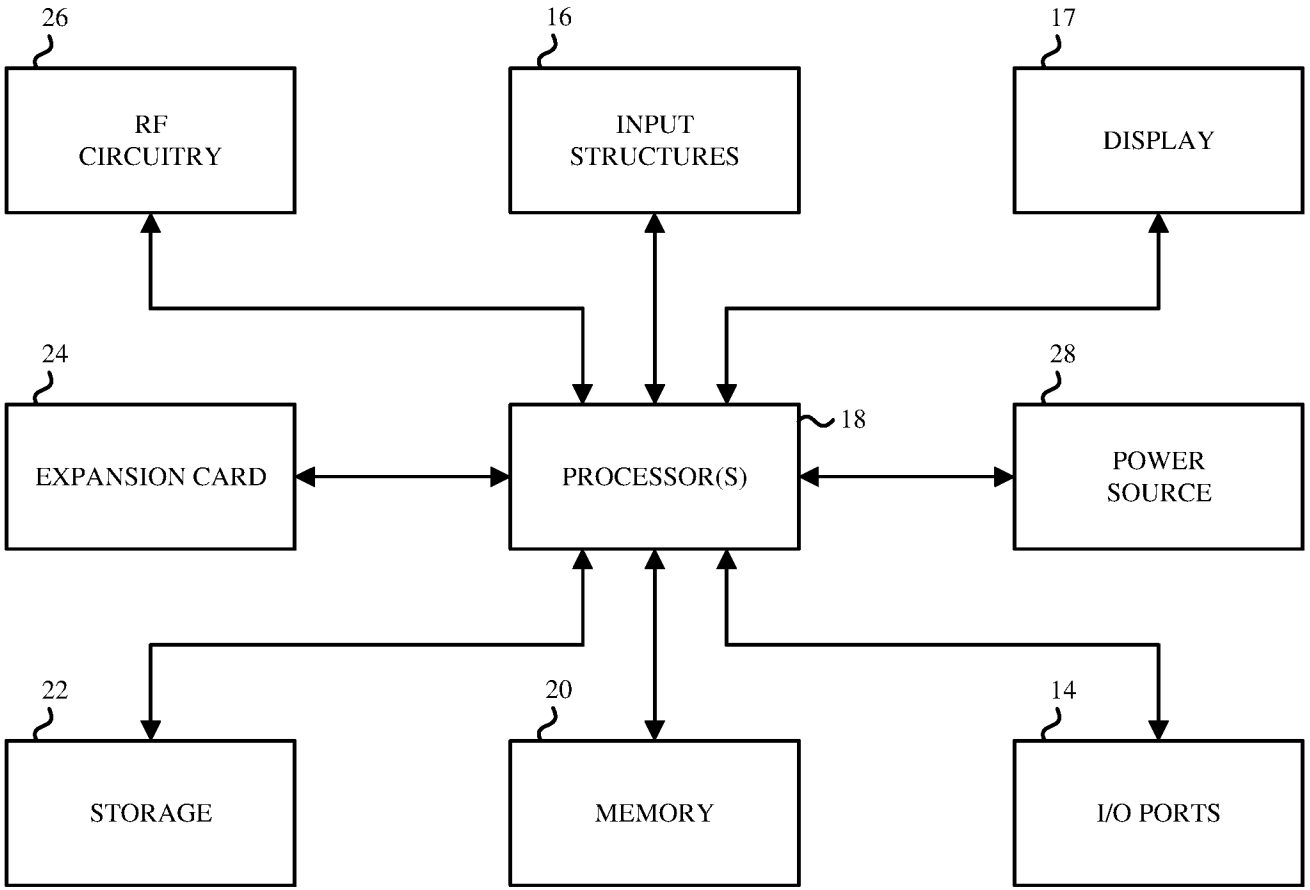
FIG. 8 is a hardware block diagram of an example electronic device in which aspects of the disclosure may be implemented.

FIG. 8 is a block diagram of exemplary hardware components of an electronic device in which the aspects described above may be implemented. The electronic device 10 may be a desktop computer, a laptop computer, a handheld portable electronic device such as a cellular phone, a personal data organizer, a tablet computer, audio-enabled smart glasses, a virtual reality headset, etc. In other aspects, the electronic device 10 may encompass multiple housings, such as a smartphone that is electronically paired with a wired or wireless headset, or a tablet computer that is paired with a wired or wireless headset. The various blocks shown in FIG. 8 may implemented as hardware elements (circuitry), software elements (including computer code or instructions that are stored in a machine-readable medium such as a hard drive or system memory and are to be executed by a processor), or a combination of both hardware and software elements. It should be noted that FIG. 8 is merely one example of a particular implementation and is merely intended to illustrate the types of components that may be present in the electronic device 10. For example, in the illustrated version, these components may include a display 17, input/output (I/O) ports 14, input structures 16, one or more processors 18 (generically referred to sometimes as "a processor"), memory device 20, non-volatile storage 22, expansion card 24, RF circuitry 26, and power source 28. An aspect of the disclosure here is a machine readable medium that has stored therein instructions that when executed by a processor in such an electronic device 10, perform the various digital speech enhancement operations described above.

While the disclosure has been described in terms of several aspects, those of ordinary skill in the art will recognize that the disclosure is not limited to the aspects described, but can be practiced with modification and alteration within the spirit and scope of the appended claims. The description is thus to be regarded as illustrative instead of limiting.

The invention claimed is:

1. A system for digital speech enhancement, the system comprising:

a processor; and memory having stored therein instructions that program a processor to execute a blind source separation (BSS) algorithm upon signals from a plurality of audio pickup channels including a microphone signal and an accelerometer signal, and perform as an accelerometer-based voice activity detector (VADa) that performs voice activity detection using the accelerometer signal and not the microphone signal to produce a VADa output that indicates a speech confidence level or a binary speech no-speech value by determining an energy level of the accelerometer signal and comparing the energy level to an energy level threshold, wherein the BSS algorithm includes a sound source separator that generates a first signal representative of a first sound source and a second signal representative of a second sound source, and a voice source detector that determines which of the first and second signals is a voice signal and which is a noise signal, and outputs the signal determined to be the voice signal as an output voice signal and the signal determined to be the noise signal as an output noise signal, wherein the processor is configured to adapt variance parameters, of a separation algorithm for generating the first signal, based on the VADa output, and wherein the first signal is determined to be the voice signal.

2. The system in claim 1, wherein the sound source separator is configured to add optimization equality constraints within a separation algorithm, wherein there is a mismatch of frequency bandwidth between the microphone signal and the accelerometer signal, and the optimization equality constraints limit adaptation of unmixing coefficients that correspond to the accelerometer signal as compared to adaptation of unmixing coefficients that correspond to the microphone signal.

3. The system of claim 2 wherein the separation algorithm is an independent vector analysis (IVA)-based algorithm.

4. The system in claim 1, wherein the sound source separator is configured to:

use a N×N unmixing matrix for a first frequency range, and use a (N−1)×(N−1) unmixing matrix for a second frequency range, wherein the first frequency range is lower than the second frequency range, and wherein N is an integer equal or greater than 2.

5. The system of claim 1 wherein the memory has stored therein instructions that program the processor to perform equalization by generating a scaled noise signal by scaling the output noise signal to match a level of the output voice signal, and noise suppression by generating a clean signal based on the scaled output noise signal and the output voice signal.

6. The system of claim 1, wherein the sound source separator is configured to generate the first and second signals, that are representative of the first sound source and the second sound source, based on determining an unmixing matrix W and based on the microphone signal and the accelerometer signal.

7. The system of claim 6, wherein the first and second signals, that are representative of the first sound source and the second sound source, are separated in a plurality of frequency bins in frequency domain and independent vector analysis (IVA) is used to determine a plurality of unmixing matrices W and align the first and second signals across the frequency bins.

8. The system in claim 1, wherein the plurality of audio pickup channels include a plurality of microphone signals from a plurality of microphones, respectively, and wherein the memory has stored therein instructions that program the processor to perform as a beamformer that generates a voicebeam signal and a noisebeam signal from the plurality of microphone signals, and a beamformer-based voice activity detector (VADb) that determines a magnitude difference between the voicebeam signal and the noisebeam signal, and generates a VADb output that indicates speech when the magnitude difference is greater than a magnitude difference threshold.

9. The system in claim 8 wherein the memory has stored therein instructions that program the processor to adapt the variance parameters further based on the VADb output.

10. A method for digital speech enhancement, the method comprising:

performing a blind source separation (BSS) process upon signals from a plurality of audio pickup channels that include a microphone signal and an accelerometer signal; and performing voice activity detection (VADa) using the accelerometer signal and not the microphone signal, by determining an energy level of the accelerometer signal and providing a VADa output that indicates a speech confidence level or a binary speech no speech value, by comparing the energy level to an energy level threshold, wherein the BSS process includes a sound source separation process that generates a first signal representative of a first sound source and a second signal representative of a second sound source, and a voice source detection process that determines which of the first and second signals is a voice signal and which is a noise signal, and outputs i) the signal determined to be the voice signal as an output voice signal and ii) the signal determined to be the noise signal as an output noise signal, wherein a plurality of variance parameters of a separation algorithm for generating the first signal are adapted based on the VADa output and the first signal is determined to be the voice signal.

11. The method of claim 10, wherein there is a mismatch of frequency bandwidth between the microphone signal and the accelerometer signal and wherein the sound source separation process comprises adding optimization equality constraints within the separation algorithm.

12. The method of claim 11 wherein the separation algorithm is an independent vector analysis (IVA)-based algorithm.

13. The method of claim 10, wherein the sound source separation process comprises using a N×N unmixing matrix for a first frequency range, and using a (N−1)×(N−1) unmixing matrix for a second frequency range, wherein the first frequency range is lower than the second frequency range, and wherein N is an integer equal or greater than 2.

14. The method of claim 10 further comprising:

generating a scaled noise signal by scaling the output noise signal to match a level of the output voice signal, and generating a clean signal based on the scaled output noise signal and the output voice signal.

15. The method of claim 10 wherein the sound source separation process comprises a. generating the first and second signals, that are representative of the first sound source and the second sound source, based on determining an unmixing matrix W and based on the microphone signal and the accelerometer signal.

16. The method of claim 15, wherein the first and second signals, that are representative of the first sound source and the second sound source, are separated in a plurality of frequency bins in frequency domain and independent vector analysis (IVA) is used to determine a plurality of unmixing matrices W and align the first and second signals across the frequency bins.

17. The method of claim 10, wherein the plurality of audio pickup channels include a plurality of microphone signals from a plurality of microphones, respectively, the method further comprising a. generating a voicebeam signal and a noisebeam signal from the plurality of microphone signals, and b. performing voice activity detection, by determining a magnitude difference between the voicebeam signal and the noisebeam signal and generating a VADb output that indicates speech confidence level or a binary speech no-speech value based on comparing the magnitude difference with a magnitude difference threshold.

18. The method of claim 17 wherein the variance parameters are adapted further based on the VADb output.

* * * * *